US006176324B1

(12) United States Patent
Cadet

(10) Patent No.: US 6,176,324 B1
(45) Date of Patent: Jan. 23, 2001

(54) DRILLING DEVICE

(75) Inventor: Bernard Cadet, Caluire (FR)

(73) Assignee: Etablissements Montabert, Saint Priest (FR)

( * ) Notice: Under 35 U.S.C. 154(b), the term of this patent shall be extended for 0 days.

(21) Appl. No.: 09/297,175

(22) PCT Filed: Nov. 18, 1997

(86) PCT No.: PCT/FR97/02075

§ 371 Date: Jun. 29, 1999

§ 102(e) Date: Jun. 29, 1999

(87) PCT Pub. No.: WO98/22693

PCT Pub. Date: May 28, 1998

(30) Foreign Application Priority Data

Nov. 18, 1996 (FR) ..... 96 14248

(51) Int. Cl.[7] ..... E21B 44/00; E21B 4/14

(52) U.S. Cl. ..... 175/40; 175/296

(58) Field of Search ..... 175/40, 46, 48, 175/24, 25, 38, 135, 92, 293, 296; 173/91, 212

(56) References Cited

U.S. PATENT DOCUMENTS 3,744,576 * 7/1973 Sudnishnikov et al. ..... 173/91
4,064,950 12/1977 Salmi et al. .
5,413,186 * 5/1995 Campbell ..... 175/296
5,634,524 * 6/1997 Campbell ..... 175/296
5,954,145 * 9/1999 Hesse et al. ..... 175/19

FOREIGN PATENT DOCUMENTS 1 322 493 7/1973 (GB) .

* cited by examiner

*Primary Examiner*—Robert E. Pezzuto
(74) *Attorney, Agent, or Firm*—Oliff & Berridge, PLC

(57) ABSTRACT

Drilling device, of the type possessing a drilling unit of which the tool is driven to rotate from a hydraulic motor associated with an advancing device enabling a bearing force of the drilling unit on the ground to be created, the various actuating members being driven from at least one hydraulic pump via a set of hydraulic distributors and a set of tubes, such as hoses, the two feed tubes of the advancing device of the drilling system being equipped with a switch for reversing the direction of circulation of the fluid in the advancing device. Mounted on one of the branches of the feed circuit of the hydraulic motor for driving the tool in rotation is a fluid measurement device constantly supplying information to a compensation device for subtracting the calculated loss of head created by all the members of the circuit between two known points in that circuit, situated on either side of the motor, from the pressure difference measured between those same two points, the result of this operation actuating the switch for reversing the direction of circulation of the advancing fluid if the value exceeds a given value.

11 Claims, 7 Drawing Sheets

FIG 4A
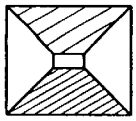
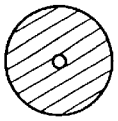
FIG 4B
FIG 5A
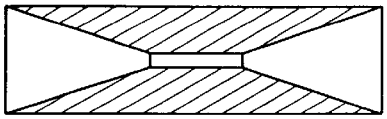
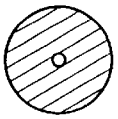
FIG 5B
FIG 6A
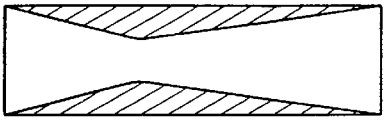
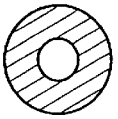
FIG 6B
FIG 7A
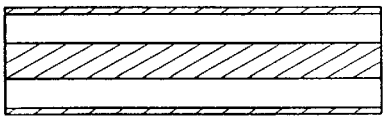
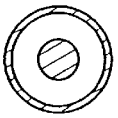
FIG 7B
FIG 8A
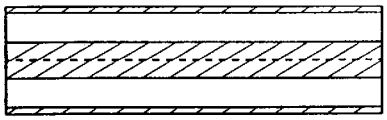
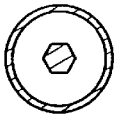
FIG 8B
FIG 9A
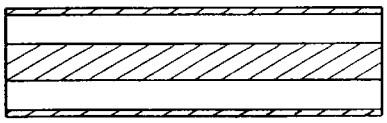
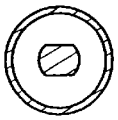
FIG 9B
FIG 10
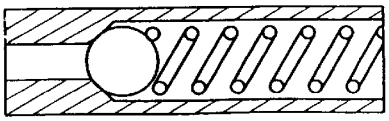
FIG 11
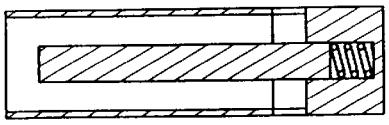

DRILLING DEVICE

BACKGROUND OF THE INVENTION

The present invention relates to a drilling device used in particular for the drilling of holes intended for the extraction of rocks and ores, in which a rotary movement is imparted to the drilling tool, this assembly being mounted on an advancing device which enables a thrust to be exerted on the tool during drilling.

It is known that the torque created by the contact of the tool or drilling head with the ground increases with the thrust applied.

It is therefore necessary to provide regulating devices enabling the thrust exerted on the tool to be adapted to the maximum torque admissible by the drive device, in order to protect the tool from risks of jamming in the drilled ground.

FIGS. 1 and 2 represent, very schematically, a rotary percussion drilling device of known type, in two operating positions. These figures show a hammer drill 1 equipped with a tool 2 associated on the one hand with an impact device 3 and on the other hand with a rotary drive device 4. The hammer drill is mounted to be displaceable relative to the ground 5 in which a bore is to be made with the aid of an advancing system 6 mounted on a slideway 7. The advancing system comprises a hydraulic ram 8 whose body is solidly fixed to the device 6 and whose column 9 bears on a fixed point. The various movements are obtained from a hydraulic pump 10 which feeds, via three distributors, 12, 13 and 14 respectively, the impact device 3, a hydraulic motor 15 and the ram 8. The connections are embodied by way of a series of hoses, 16, 17 and 18 respectively. The feed circuit of the hydraulic motor for driving the tool in rotation comprises the hoses between the hydraulic pump 10 and the distributor 13, the distributor 13, the hose 17*a*, the rotary motor 15, the return hose 17*b* and the hose between the distributor 13 and the return to atmosphere. A circuit reversing device 19 is placed in the circuit situated between the distributor 14 and the ram 8 for advancing the drilling device. The reversing system 19 is controlled by the pressure of rotation of the motor 15, ensuring the rotational drive of the drill. The maximum admissible rotational pressure at which the reversing system reacts is adjustable. The information pick-up of this system is, nevertheless, very distant from the inlet of the motor 15, for reasons of bulk, which results in very substantial hose lengths.

Below the maximum admissible rotational pressure, the fluid feed of the various motor members takes place, as shown in FIG. 1, via the hoses shown in solid lines. The reversing system 19 is in its position of rest and does not act on the advancing circuit. In the event that the tool 2 becomes jammed in the ground, the rotational pressure increases. If the pressure exceeds a predetermined value, set on the reversing system 19, the latter reverses the feed direction of the ram 8, as shown in FIG. 2, allowing the tool to move back.

In such a case, the hydraulic rotational pressure of the motor is not measured directly, and the drill is very remote from the control system. The measured pressure is the sum of the rotational pressure of the motor and the losses of line head within the circuit formed by the hose 17. However, the losses of head within a circuit are very variable as a function of temperature, which influences viscosity, and of the hydraulic fluid flow.

In order to work in all conditions, it is necessary to adjust the reversing switch device 19 to a value such that the maximum admissible rotational pressure is equal to the rotational pressure plus the maximum loss of head.

The rotational pressure due to mechanical torque being constant, the losses of head are for their part variable as a function of temperature. The measured pressure is therefore variable as a function of temperature. This type of device does not allow fine adjustment of the reversing system.

SUMMARY OF THE INVENTION

In order to remedy these disadvantages, the Applicant uses a drill in which the output of the motor is directed towards the intake of the part providing the impact. An identical flow is directed towards the part providing the impact and is accumulated with the output of the motor providing the rotation of the tool. The torque is measured by differential measurement of the pressure between the intake and output of the rotation motor. In this case, the measured rotational pressure is equal to the rotational pressure at the boundaries of the motor, excluding the losses of head in the rotation circuit.

This solution enables the reversing system to be actuated correctly. However, incorporating it complicates the implementation of the other hydraulic functions, because of the dependence of the rotation and impact circuits on the drill.

The object of the invention is to provide a drilling device which makes it possible to avoid the losses of head in the hydraulic circuit feeding the motor which drives the tool in rotation, by virtue of the variable nature of these losses of head as a function of temperature and of the hydraulic fluid flow, while making it possible to retain optimum adjustment of the maximum value of the admissible torque over the entire operating range of the device, without requiring complex technical solutions, especially from a hydraulic point of view.

To this end, the drilling device to which the invention relates, of the type possessing a drilling unit of which the tool is driven to rotate from a hydraulic motor associated with an advancing device enabling a bearing force of the drilling unit on the ground to be created, the various actuating members being driven from at least one hydraulic pump via a set of hydraulic distributors and a set of tubes, such as hoses, the two feed tubes of the advancing device of the drilling system being equipped with a switch for reversing the direction of circulation of the fluid in the advancing device, is characterized in that mounted on one of the branches of the feed circuit of the hydraulic motor for driving the tool in rotation is a fluid characteristics measurement device constantly supplying information to a compensation device for subtracting the calculated loss of head created by all the members of the circuit between two known points in that circuit, situated on either side of the motor, from the pressure difference measured between those same two points, the result of this operation actuating the switch for reversing the direction of circulation of the advancing fluid if the value exceeds a given value.

Such a device enables the direction of displacement of the drill on its slideway to be reversed automatically in order to prevent the jamming of the drilling tool in the soil if the rotational pressure exceeds the maximum admissible rotational pressure.

The measuring device sends to the compensation device a measurement of the loss of head proportional to that of the rotation circuit.

The compensation device uses this information to actuate the reversing system if the increase in rotational pressure is due to an increase in the mechanical torque.

If the increase in rotational pressure is due to a variation in the losses of head in the rotation circuit, the reversing system is not actuated.

The measuring device, the compensation device and the reversing switch, and the transmission of information between these various members, may be mechanical, hydraulic, pneumatic, electronic or electrical.

The advantage of this structure lies in the fact that variations in the pressure of the fluid driving the motor which drives the drilling system in rotation that are due to variations in the loss of head in the circuit do not affect the value of the maximum admissible rotational pressure. Only a variation in the pressure of rotation due to contact between the tool and the ground triggers a reaction by the reversing system.

According to a feature of the invention, this device comprises a device for measuring the flow rate and viscosity of the hydraulic fluid whose head loss characteristics are proportional to those of the hydraulic feed circuit of the motor driving the tool in rotation.

The measuring device may take the form of a throttle.

According to another embodiment, this drilling device possesses an electrical or electronic measuring device comprising an analogue or digital differential pressure sensor or a temperature sensor associated with a flowmeter, generating a signal actuating a hydraulic or electrical compensation system acting on the reversing switch.

The compensation devise may comprise a regulatory slide valve mounted to slide in a bore and subjected, respectively, to the hydraulic fluid pressures upstream and downstream of the throttle. The slide valve may be mechanically connected to the reversing switch in order to actuate the latter directly, or the displacement of the slide valve may be measured by a potentiometric device of electrical or hydraulic type which generates an output signal that actuates the reversing switch.

According to another possibility, the reversing switch is integrated in the compensation device whose slide valve possesses several channels, offset axially and forming parts of the two branches of the hydraulic feed circuit of the device for advancing the drill, to enable the fluid to circulate in two opposite directions as a function of the axial position of the slide valve.

According to another embodiment, it possesses a hydraulic or pneumatic potentiometer possessing a slide valve whose ends are subjected to the hydraulic pressures upstream and downstream of the throttle, respectively, and possessing a central channel feeding the reversing switch either from a channel connected to a high-pressure source or from a channel connected to a low-pressure source, depending on the position of the slide valve.

BRIEF DESCRIPTION OF THE DRAWINGS

In any event, the invention will be clearly understood with the aid of the description which follows, with reference to the diagrammatic drawing attached which shows, by way of non-limiting examples, a plurality of device embodiments:

FIGS. 4*a* to 11 are views corresponding to eight different embodiments of the measuring device;

FIG. 3 shows a device similar to that in FIGS. 1 and 2, in which the same members are indicated by the same reference numbers as before. In this device, a device 22 is provided for measuring the loss of hydraulic head, connected into the hydraulic circuit feeding the motor 15 for driving the tool in rotation. This device measures, at all times, the viscosity and flow rate of the fluid in the circuit and generates an output signal proportional to the loss of head which exists in the hydraulic circuit as a whole.

The information on loss of head is sent to a compensation device 23 which permanently uses this information in order to compensate for the effects of the losses of head in the hydraulic circuit and actuate the reversing switch 19.

The measuring device may be mechanical, electrical, hydraulic or pneumatic, sensitive to variations in viscosity and flowrate of the fluid passing through it.

This device may, for example, take the forms shown in FIGS. 4*a* to 11. These figures show fixed or adjustable throttles of the short aperture type (FIGS. 4*a* and 4*b*), or the long aperture type (FIGS. 5*a* and 5*b*), of Venturi shape (FIGS. 6*a* and 6*b*) or annular (FIGS. 7*a* and 7*b*), it being possible for the central portion to be of circular cross section, as shown in FIGS. 7*a* and 7*b*, or prismatic cross section (FIGS. 8*a* and 8*b*), or mixed cross section (FIGS. 9*a* and 9*b*). It is likewise possible to provide variable throttles as shown in FIGS. 10 and 11. In the case of a mobile throttle, as shown in FIG. 10, the loss of head of the throttle causes displacement of the mobile part.

Downstream and upstream of the throttle, the passage cross sections are much greater than the cross section of the throttle. The throttle may be located in the axis of the reversing system, and/or comprise a plurality of throttles of different or similar types. All of these different types of throttle make it possible to generate a loss-of-head characteristic proportional to that of the hydraulic circuit of the motor 15. The loss-of-head information is sent to the compensation device 23.

Figure 1:
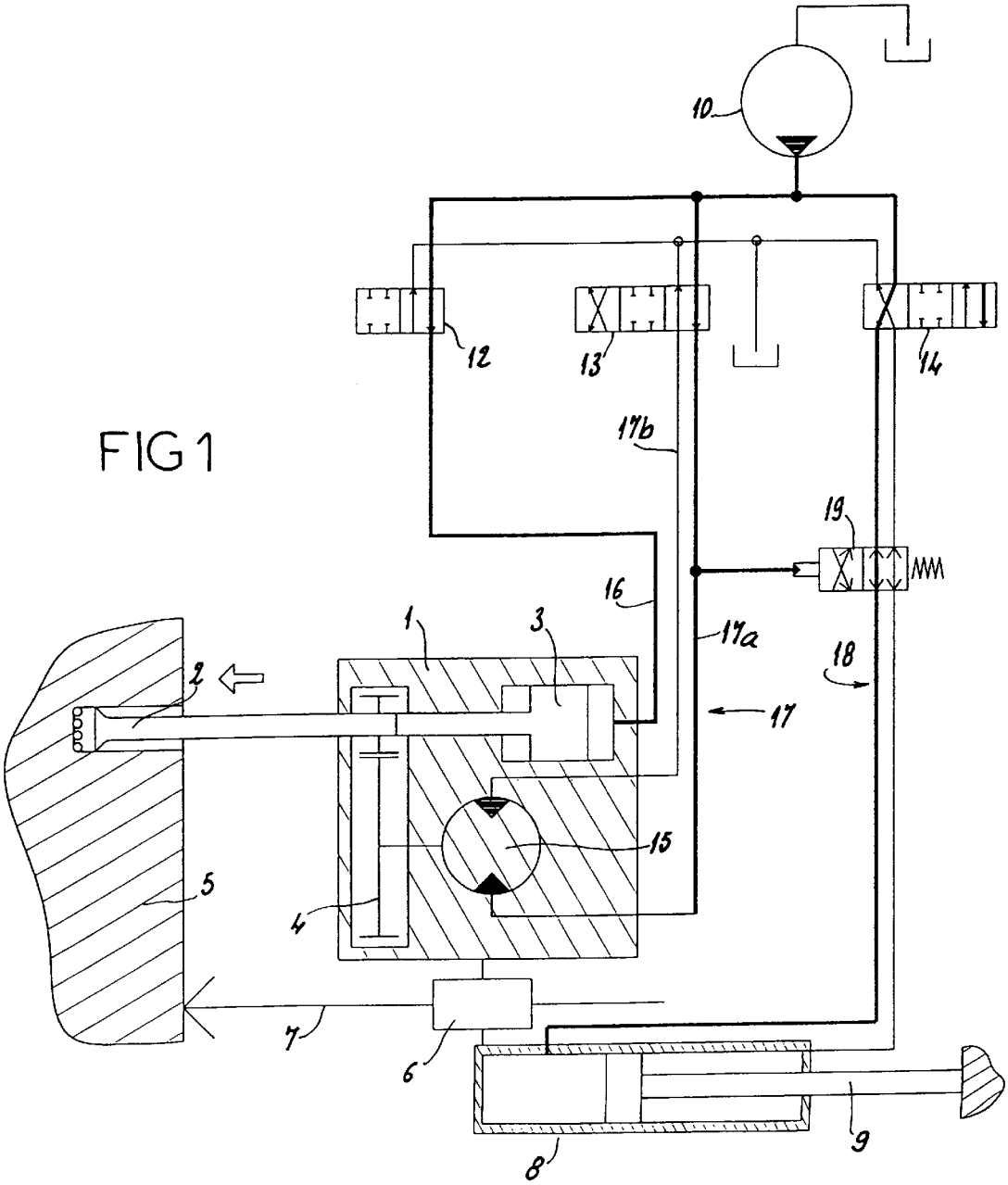
FIGS. 1 and 2 are two views in two operating positions of a rotary percussion drilling device of known type.
Figure 2:
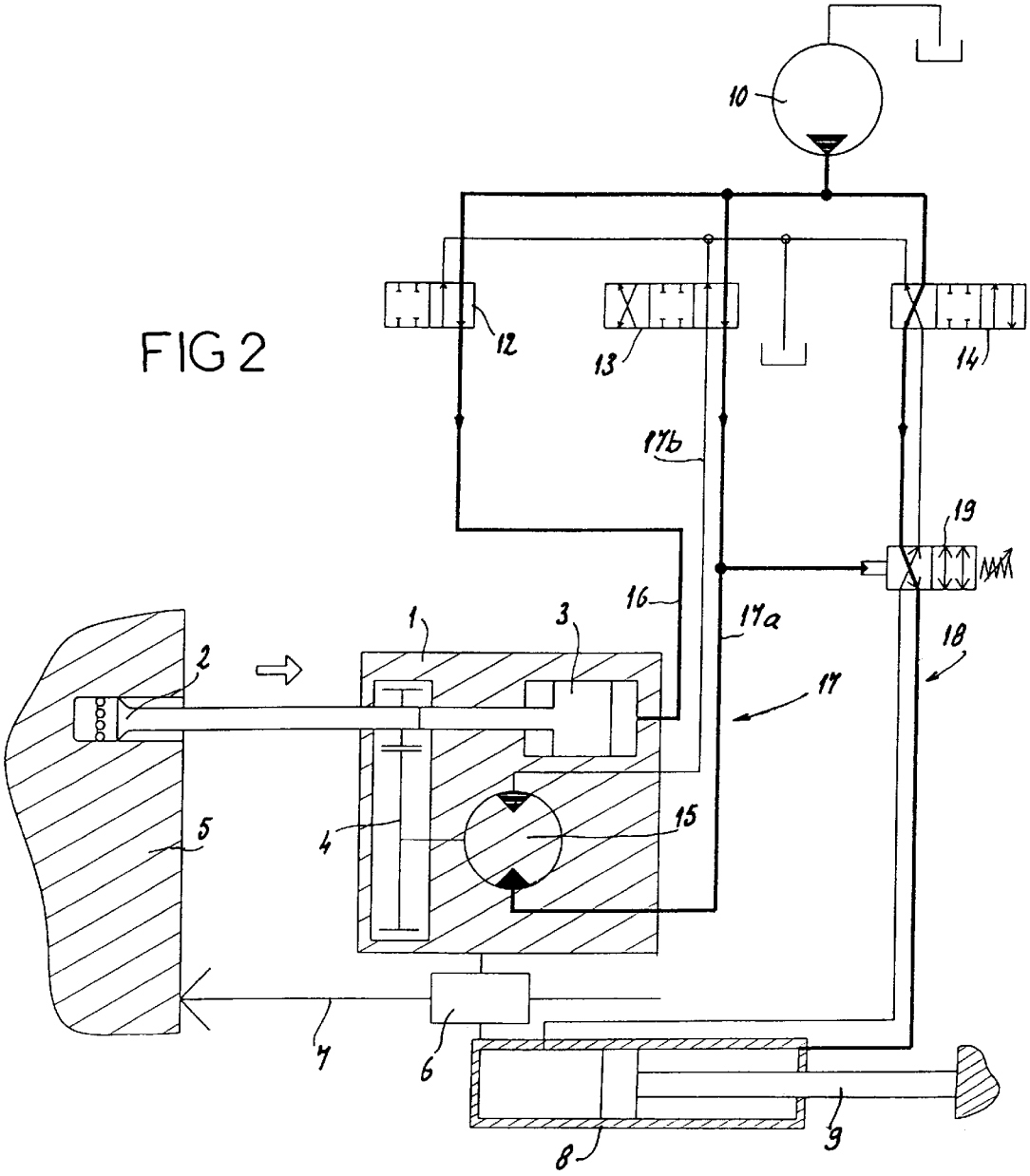
Figure 3:
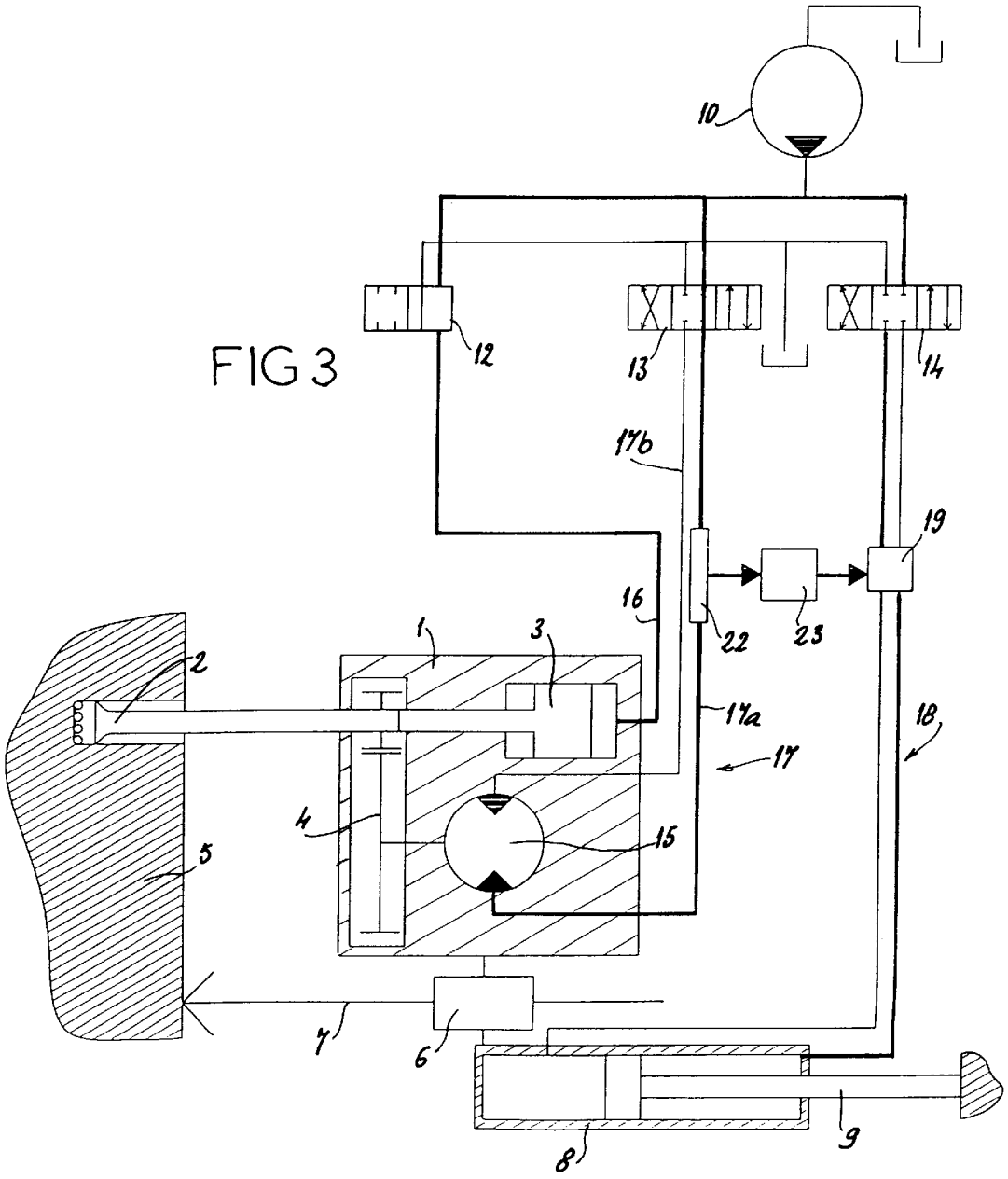
FIG. 3 is a view of a rotary percussion device according to the invention, of the same type as that shown in FIGS. 1 and 2.
Figure 12:
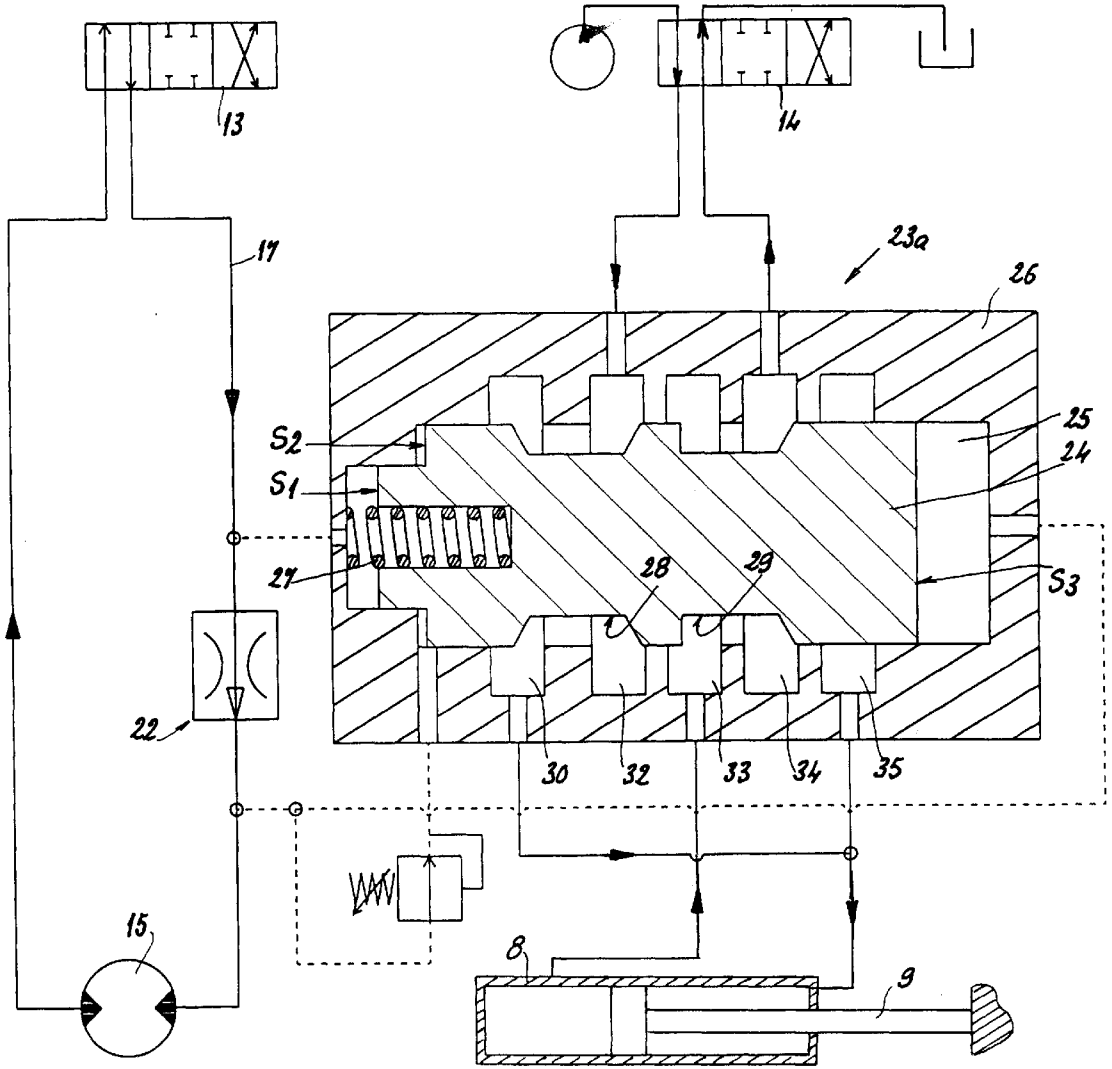
FIG. 12 is a view of an embodiment of the measuring device and the compensation device.

FIG. 12 shows such a compensation device, actuated purely mechanically. In this embodiment, the compensation device 23*a* possesses a slide valve 24 mounted to slide in the bore 25 of a block 26. The slide valve possesses three different sections, S1, S2 on a first face and S3 on the opposite face. The surface area of the section S3 is equal to the sum of the surface areas of the sections S1 and S2. The section S1 is connected to the hydraulic pressure of the feed circuit of the motor 15 upstream of the throttle 22. The section S2 is connected to a drain or to a constant pressure. The section S3 is connected to the pressure of the hydraulic feed circuit of the motor 15 downstream of the throttle 22. The ratio between the sections S1 and S2 is equal to the ratio between the loss of head of the hydraulic circuit between two known points in that circuit and the loss of head between the intake and the output of the throttle. A spring 27 creates a force opposed to the force created by the pressure acting on the section S3. The sum of the force created by the constant pressure on the section S2 and the loading of the spring 27 is equal to the force created by the maximum admissible hydraulic pressure for the feed circuit of the motor 15 acting on the section S2.

In the embodiment shown in FIG. 12, the reversing switch is integrated with the compensation device 23*a*. To this end, the slide valve 24 possesses two channels 28, 29, offset axially relative to one another, while the body possesses a plurality of grooves 30, 32, 33, 34 and 35 forming part of the two branches of the hydraulic feed circuit of the device for advancing the drill, in order to allow the circulation of the fluid in two opposite directions as a function of the axial position of the slide valve.

The channel 30 allows the function of inversion of the direction of displacement to be implemented when the slide valve is located in its end position.

In practice, the hydraulic fluid arrives through the tube 17, passes into the throttle 22 and is sent towards the motor 15, before returning by the return branch. The loss of head created in the throttle is proportional to the loss of head existing in the rotation circuit.

A variation in temperature and/or fluid flow changes the loss of head in the hydraulic circuit. This variation in loss of head in the circuit is accompanied by a variation in the same direction, but in a given ratio, of the loss of head in the throttle 22. This loss of head acts on the slide valve in opposition to the increase in the rotational pressure. The ratio between the sections S1 and S2 is equal to the ratio between the loss of head in the hydraulic circuit between two known points in that circuit and the loss of head between the intake and the output of the throttle. The balance of the forces acting on the slide valve is unchanged.

An increase in the mechanical torque on the tool is reflected by an increase in the rotational pressure. The losses of head which are independent of the torque remain the same. In this case, the resultant of the forces applied to the slide valve changes and the slide valve moves against the action of the spring towards a new equilibrium position, such as that shown in FIG. 12.

Figure 13:
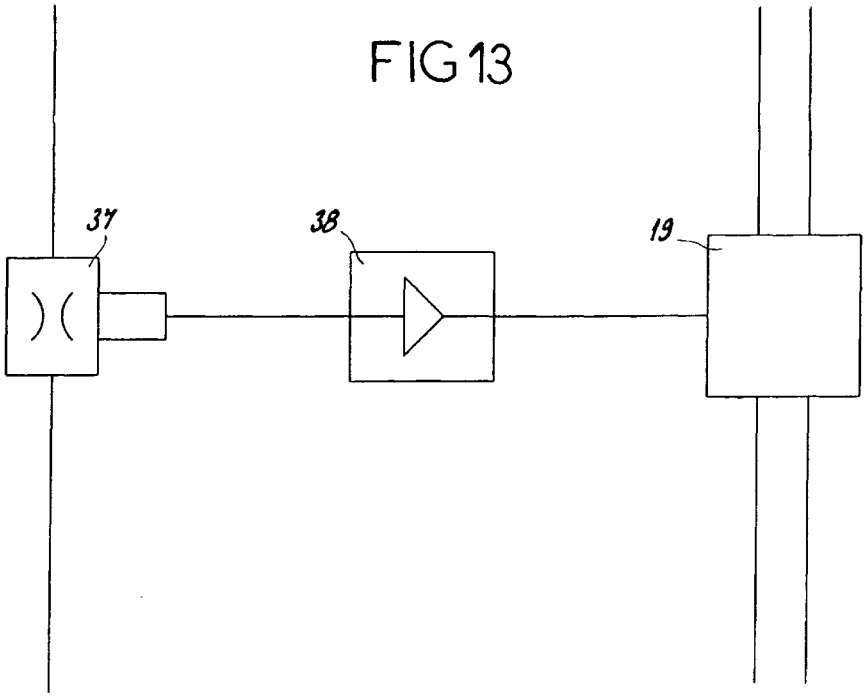
FIG. 13 is a highly schematic view of a measuring device and a compensation device.

FIG. 13 shows a device in which the measurement is undertaken by an analogue or digital differential pressure sensor 37, or a temperature sensor associated with a flowmeter. The signal generated by this measuring device is transmitted to a compensation device 38 comprising an electrical or electronic system incorporating a signal processing card or a calculator, and acting on the reversing switch of the hydraulic circuit 19.

Figure 14:
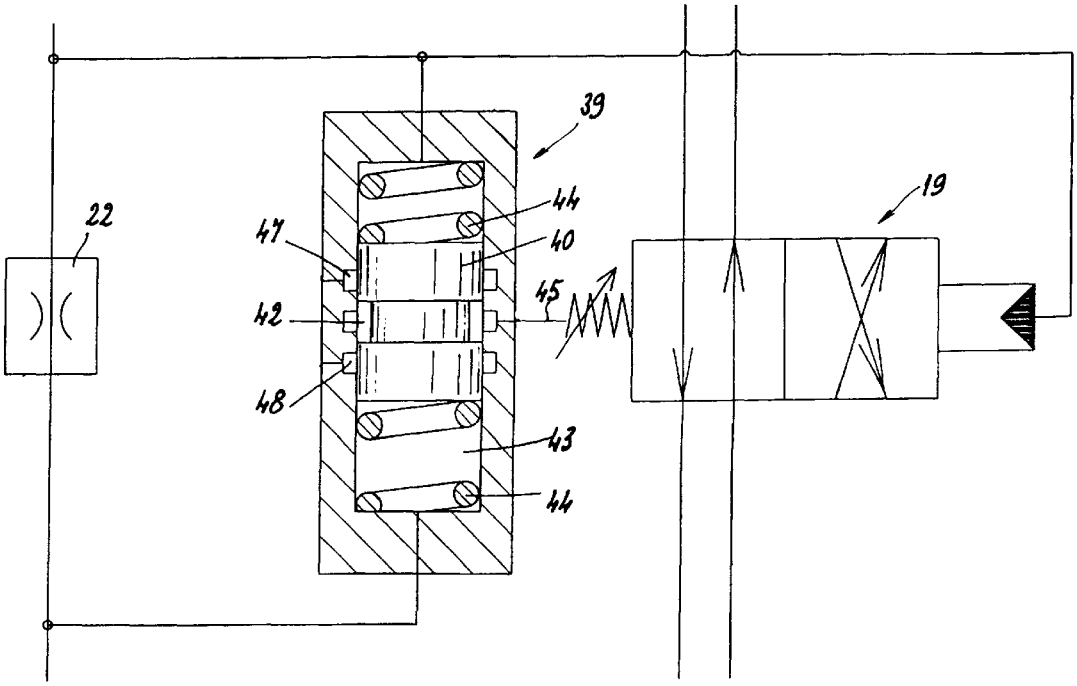
FIGS. 14 and 15 are two alternative embodiments of a measuring device and a compensation device employing a hydraulic potentiometer.

FIG. 14 shows a drilling device possessing a throttle 22 forming a measuring device, associated with a compensation device 39 comprising a hydraulic potentiometer. This hydraulic potentiometer comprises a slide valve 40 possessing a central channel 42 moving within a bore 43 and subject to the action of spring 44. The output pressure of the channel 42 directly feeds, at 45, the reversing switch 19. The two faces of the slide valve 40 are subject to the pressures, respectively, upstream and downstream of the throttle 42. Two channels 47 and 48 made in the body of the compensation device are connected to a high pressure and a low pressure, respectively.

When the loss of head in the throttle 22 increases, the slide valve moves towards the high-pressure channel 47. The output pressure of the compensator device increases, serving to increase the maximum admissible rotational pressure to which the reversing switch 19 has been set.

Figure 15:
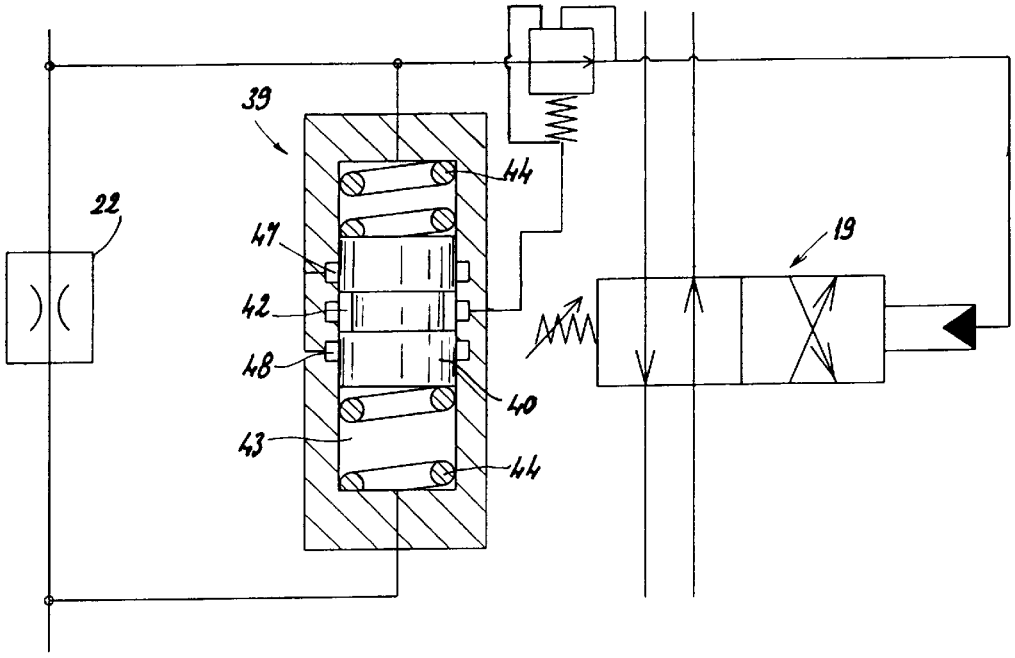

FIG. 15 is an alternative embodiment of FIG. 14, in which the same members are designated by the same references as above. In this case, the action on the reversing switch arises by reduction of the pressure actuating the reversing switch.

Figure 16:
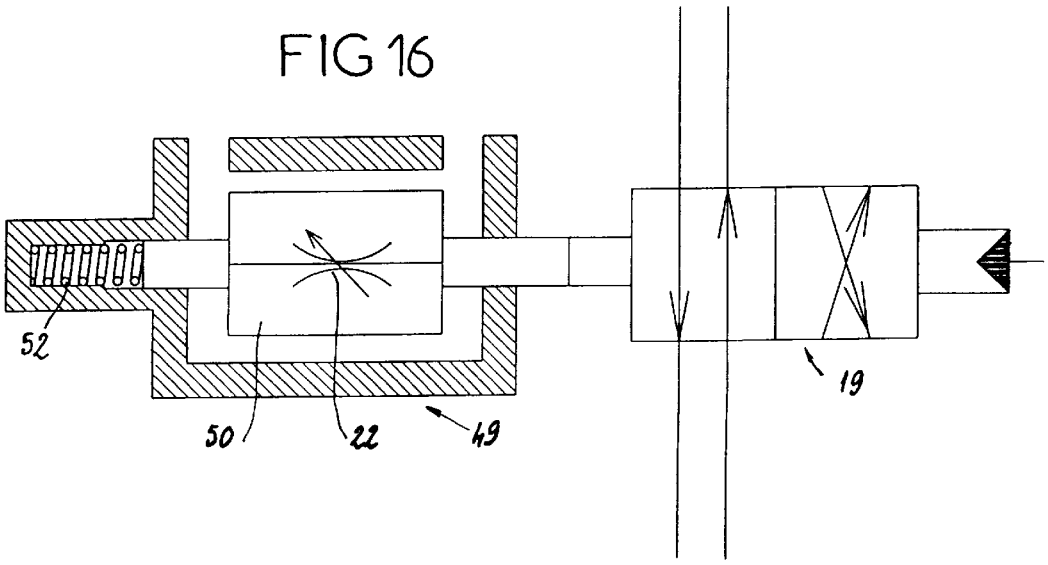
FIG. 16 is a schematic view of a device in which the measurement is incorporated into the compensation device.

FIG. 16 shows an embodiment in which a throttle 22 is integrated into the compensator device 49. The transmission of the measurement of loss of head between the compensation device 49 and the reversing switch 19 is mechanical. The throttle 22 is subject to the loss of head in the hydraulic feed circuit of the motor 15. The pressure difference allows displacement of a slide valve 50 which modifies the maximum admissible rotational pressure set on the reversing system by action on the spring 52.

As is apparent from the foregoing, the invention brings a great improvement by supplying a device making it possible to obtain, in a drilling system, compensation for the losses of head in the hydraulic circuit driving the motor imparting the rotation, which makes it possible to maintain optimum adjustment of the maximum value of the admissible torque over the entire operating range of the system, while employing simple means.

As goes without saying, the invention is not confined solely to the embodiments of this device described above by way of examples, but embraces all alternative embodiments thereof. Thus, in particular, the type of drive system for advancing the drill is in no way restrictive and could take the form, for example, of a hydraulic motor driving a sprocket-and-chain system, without thereby departing from the scope of the invention.

What is claimed is:

1. A drilling device, comprising: a drilling unit including a tool rotatably driven by a hydraulic motor associated with an advancing device enabling a bearing force of the drilling unit on the ground to be created;

an impact device of the tool, the advancing device and the hydraulic motor being driven by at least one hydraulic pump via a set of hydraulic distributors and a set of tubes, two feed tubes of the advancing device of the drilling unit being equipped with a switch for reversing the direction of circulation of the fluid in the advancing device;

a measurement device mounted on one of the tubes of a feed circuit of the hydraulic motor constantly supplying information to a compensation device for subtracting a calculated loss of head between two points in the feed circuit, situated on either side of the motor, from the pressure difference measured between those same two points, and actuating the switch for reversing the direction of circulation of the fluid in the advancing device if the value exceeds given value.

2. A drilling device according to claim 1, wherein the measurement device measures the flow rate and viscosity of the hydraulic fluid whose head loss characteristics are proportional to those of the hydraulic feed circuit of the motor rotatable driving the tool.

3. A drilling device according to claim 1 wherein the measurement device includes a throttle whose head loss characteristics as a function of flow rate and viscosity are proportional to those of the feed circuit of the motor rotatably driving the tool.

4. A drilling device according to claim 3, wherein the compensation device includes a regulatory slide valve mounted to slide in a bore, having, on one of its faces, a section subject to the pressure of hydraulic fluid downstream of the throttle, and on its opposite face two sections whose sum is equal to the surface area of the first section, of which one section is subject to the pressure of hydraulic fluid upstream of the throttle and the other section is subject to a constant pressure, the ratio between the two sections being equal to the ratio between the loss of head in the feed circuit between the two points in the feed circuit and the loss of head between the intake and output of the throttle, the measured loss of head creating an imbalance of the forces on the slide valve which displaces the slide valve.

5. A drilling device according to claim 4, wherein the reversing switch is integrated in the compensation device, the slide valve including a plurality of channels, offset axially and forming parts of two branches of a hydraulic feed circuit of the advancing device, to enable the fluid to circulate in two opposite directions as a function of the axial position of the slide valve.

6. A drilling device according to claim 4, characterized in that the slide valve is mechanically connected to the reversing switch and actuates the reversing switch directly.

7. A drilling device according to claim 4, wherein the displacement of the slide valve is measured by a potentiometric device which generates an output signal that actuates the reversing switch.

8. A drilling device according to either of claim 1, wherein the measurement device includes an analogue or digital differential pressure sensor or a temperature sensor associated with a flowmeter, generating a signal actuating a hydraulic or electrical compensation system acting on the reversing switch.

9. A drilling device according to claim 3, wherein a hydraulic or pneumatic potentiometer including a slide valve whose ends are subjected to the hydraulic pressures upstream and downstream of the throttle, respectively, and including a central channel feeding the reversing switch either from a channel connected to a high-pressure source or from a channel connected to a low-pressure source, depending on the position of the slide valve.

10. Drilling device according to claim 2, wherein the measuring device possesses a throttle whose head loss characteristics as a function of flow rate and viscosity are proportional to those of the hydraulic feed circuit of the motor driving the tool in rotation.

11. Drilling device according to claim 2, wherein it possesses an electrical or electronic measuring device comprising an analogue or digital differential pressure sensor or a temperature sensor associated with a flowmeter, generating a signal actuating a hydraulic or electrical compensation system on the reversing switch.

* * * * *